United States Patent [19]

Narozny

[11] 4,027,941

[45] June 7, 1977

[54] TERMINATION METHOD AND APPARATUS FOR FLAT FLEXIBLE CABLE

[75] Inventor: Ronald S. Narozny, Panorama City, Calif.

[73] Assignee: Thomas & Betts Corporation, Elizabeth, N.J.

[22] Filed: Nov. 1, 1976

[21] Appl. No.: 737,952

[52] U.S. Cl. ..... 339/14 R; 339/98

[51] Int. Cl.[2] ..... H01R 3/06

[58] Field of Search ..... 339/14, 97–99

[56] References Cited

UNITED STATES PATENTS

| | | | |
|---|---|---|---|
| 3,768,067 | 10/1973 | Rault | 339/99 R |
| 3,912,354 | 10/1975 | Campbell et al. | 339/99 R |
| 4,005,921 | 2/1977 | Hadden et al. | 339/14 R |

*Primary Examiner*—Joseph H. McGlynn
*Attorney, Agent, or Firm*—David Teschner; Jesse Woldman

[57] ABSTRACT

Means for simultaneously interconnecting selective conductors of an insulated multiconductor flat cable include a pair of mating metallic strips adapted to overlie opposite sides of a given segment of the cable and include a first strip having bifurcated contact elements arranged to pierce through the cable insulation about selective conductors and enter preformed apertures in the other strip, which apertures are dimensioned to snugly receive and contain the tines of the bifurcated contact elements. A dielectric housing may be provided to enclose and insulate the various elements of the assembly.

25 Claims, 11 Drawing Figures

TERMINATION METHOD AND APPARATUS FOR FLAT FLEXIBLE CABLE

BACKGROUND OF THE INVENTION

1. Field of the Invention

The invention is directed to the field of terminating devices for multiconductor insulated flat cable and the like.

2. Description of the Prior Art

The use of flat flexible multiconductor cable for interconnecting electrical components and devices has become increasingly popular in recent years and has engendered the design of various connectors and terminating devices adapted to such cable. In many cases, however, the user is required to strip the insulation from selective portions of the conductors to permit the connection thereof to the contact elements of such devices. Examples of such designs are disclosed in U.S. Pat. No. 3,816,818 issued to H. Meier on June 11, 1974; U.S. Pat. No. 3,777,299 issued on Dec. 4, 1973 to E. F. Nickerson et al. and assigned to the assignee of the instant invention; and U.S. Pat. No. 3,713,073 issued on Jan. 23, 1973 to R. S. Narozny, applicant herein, and assigned to the assignee of the instant invention. Attempts to at least partially overcome the limitations inherent in the above noted devices are exemplified in U.S. Pat. No. 3,903,708 issued to A. D. Wedekind on Jan. 6, 1976; and U.S. Pat. No. 3,912,354 issued on Oct. 14, 1975 to D. S. Campbell et al. The latter two patents disclose flat cable connectors having discrete insulation piercing type contact elements adapted to eliminate the need for stripping selective portions of the insulated conductors prior to engagement or attachment thereto. In many cases, however, there is a need for joining several spaced-apart conductors of such flat cable to a common juncture where, for example, the cable is employed to transmit pulse or high frequency signals and it is desired to provide suitable isolation between the signal carrying conductors. In such cases, the conductors flanking the signal carrying conductor are generally grounded by individually interconnecting each of the discrete contact elements engaging the flanking conductors to provide a common electrical junction which may then be connected to a convenient ground point. Since the spacing between adjacent conductors may be in the order of 0.050 inches or, in the case of miniaturized cable, approximately one half of such dimension, the interconnecting operation may entail a laborious, time consuming, and relatively expensive manual manipulation in which great care must be exercised to prevent inadvertent shorting between adjacent contact elements.

SUMMARY OF THE INVENTION

The invention overcomes the limitations and difficulties noted above with respect to prior art devices by providing a simple, rapid, inexpensive, and reliable means and method for simultaneously interconnecting selective conductors of a multiconductor insulated flat cable. The interconnection is accomplished by providing a pair of selectively formed integral metallic strips, one of which is provided with upstanding contact elements having bifurcated piercing tines preferably conveniently formed in a blanking or stamping operation and arranged in selectively spaced preselected order, the other strip comprising a series of tine receiving apertures arranged to coincide with and accept respective piercing tines on the first strip, and which may be formed by lancing so as to produce a pair of opposing outwardly extending tangs flanking each aperture. Each of the strips may be supported within a suitably formed housing of dielectric material which may comprise a base member and cover member each having means for interlocking the two members together to provide a connector assembly. To accomplish the simultaneous interconnection of selected conductors, the two strips are placed on opposite sides of a given segment of the flat cable and aligned so that their respective longitudinal axes are oriented generally perpendicular to the longitudinal axis of the cable, with the piercing tines in coaxial alignment with the tine receiving apertures. The strips are then urged together to cause the tines to pierce through the insulation surrounding the selected conductors while providing electrical contact therewith, the tines being of sufficient length to traverse the entire thickness of the cable and enter the respective apertures in the opposing strip. The apertures are suitably dimensioned so as to snugly receive the tines preferably in locking engagement, a feature which advantageously prevents further spreading of the tines and insures continued engagement of the inner edges of the tines with the respective conductive portions of the selected conductors despite handling, movement, vibration, or other like conditions. Where each aperture is formed by lancing and there are provided flanking tang members, the tang members are arranged to provide resilient locking means engaging the tines to exert a given inward pressure thereon to further facilitate the locking action. The housing members may be suitably formed so as to further include discrete contact members positioned adjacent the contiguous strips for engaging other conductors of the flat cable to provide separate connections between such other conductors and a further electrical part or device. It is therefore an object of this invention to provide an improved terminating means and method for multiconductor flat flexible cable.

It is another object of this invention to provide a means and method for simultaneously interconnecting a plurality of selected conductors of a multiconductor flat, flexible cable.

It is a further object of this invention to provide a rapid and reliable means and method for interconnecting selected conductors of a multiconductor flat, flexible cable.

It is still another object of this invention to provide a connector having a self-contained juncture strip for interconnecting selected conductors of a multiconductor flat, flexible cable.

It is yet a further object of this invention to provide a composite connector assembly having both integral and discrete contact means.

It is still a further object of this invention to provide a self-locking assembly for simultaneously interconnecting selected conductors of a multiconductor flat, flexible cable.

It is yet another object of this invention to provide a reliable, efficient, and rapid means and method for simultaneously interconnecting closely spaced selected conductors of a multiconductor flat, flexible cable.

Other objects and features will be pointed out in the following description and claims and illustrated in the accompanying drawings which disclose, by way of example, the principle of the invention and the best mode contemplated for carrying it out.

BRIEF DESCRIPTION OF THE DRAWINGS

In the Drawings

Similar elements are given similar reference characters in each of the respective drawings.

DESCRIPTION OF THE PREFERRED EMBODIMENTS

Figure 1:
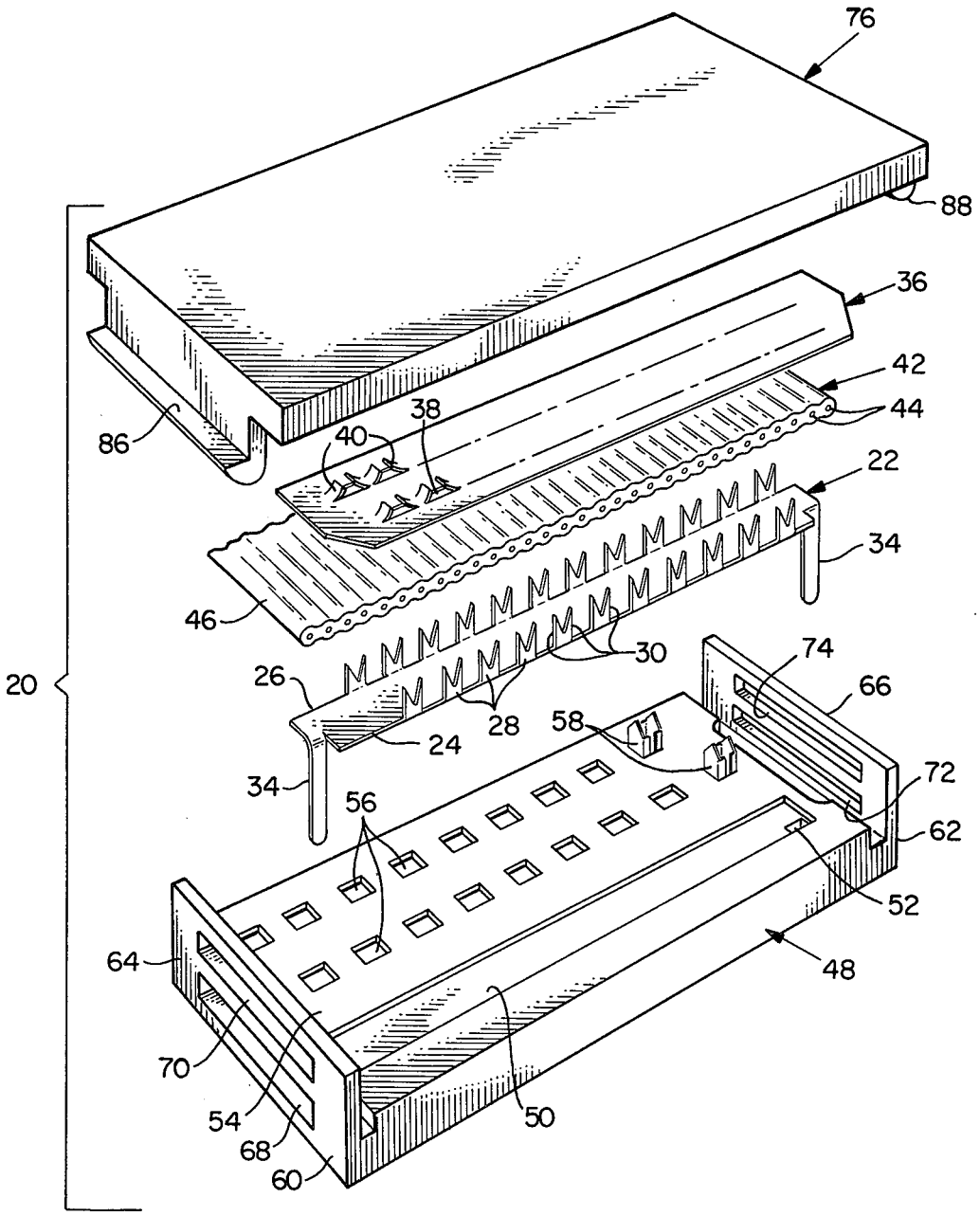
FIG. 1 is a exploded perspective view of a terminating means constructed in accordance with the concepts of the invention.
Figure 2:
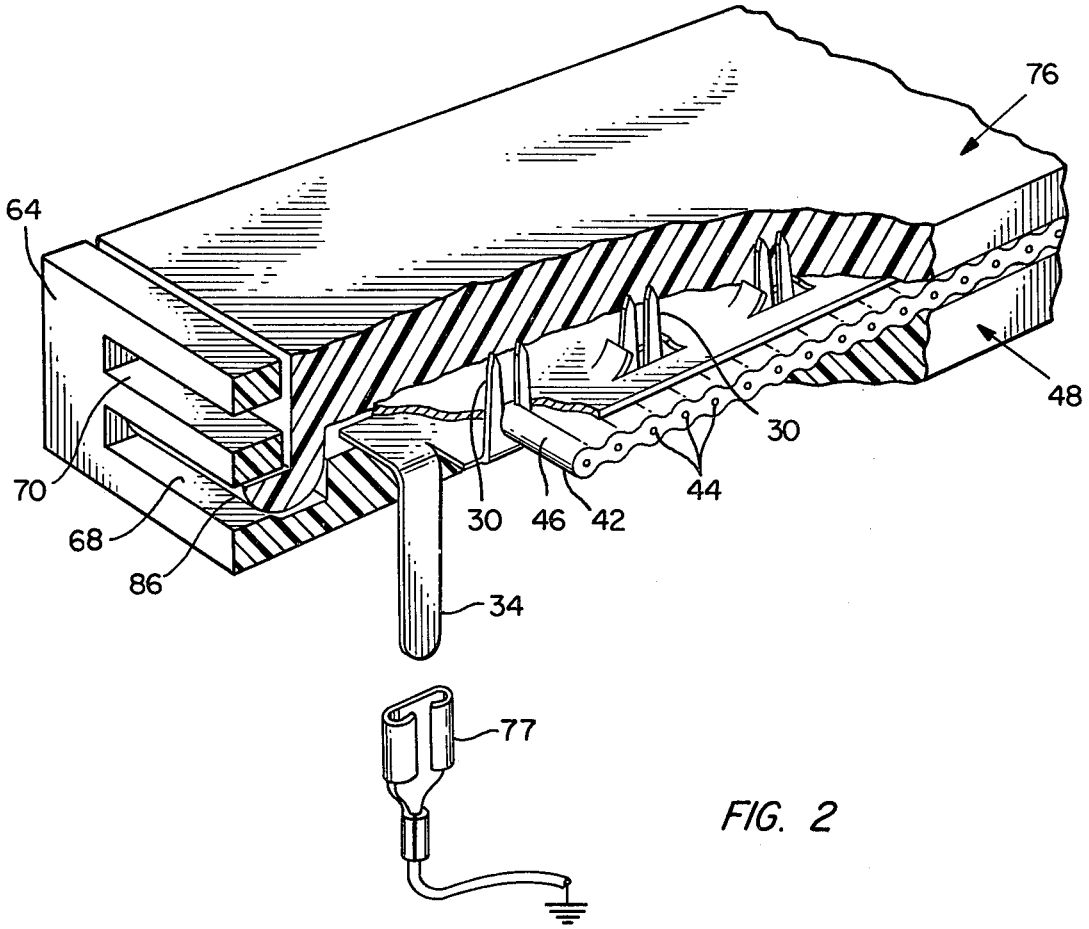
FIG. 2 is a fragmentary perspective view, partly cut away and partly in section, showing the device of FIG. 1 in an assembled state.
Figure 3:
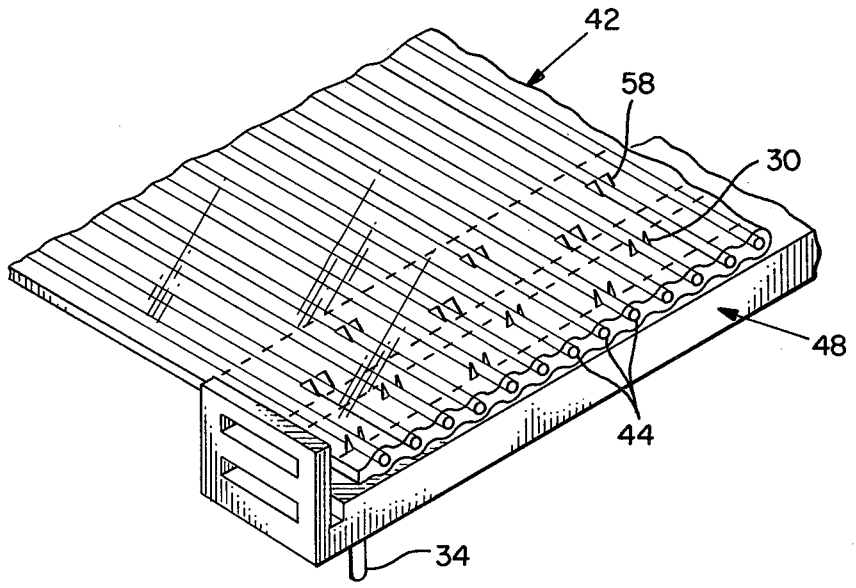
FIG. 3 is a fragmentary perspective view showing a partial assembly of the device of FIG. 1.
Figure 4:
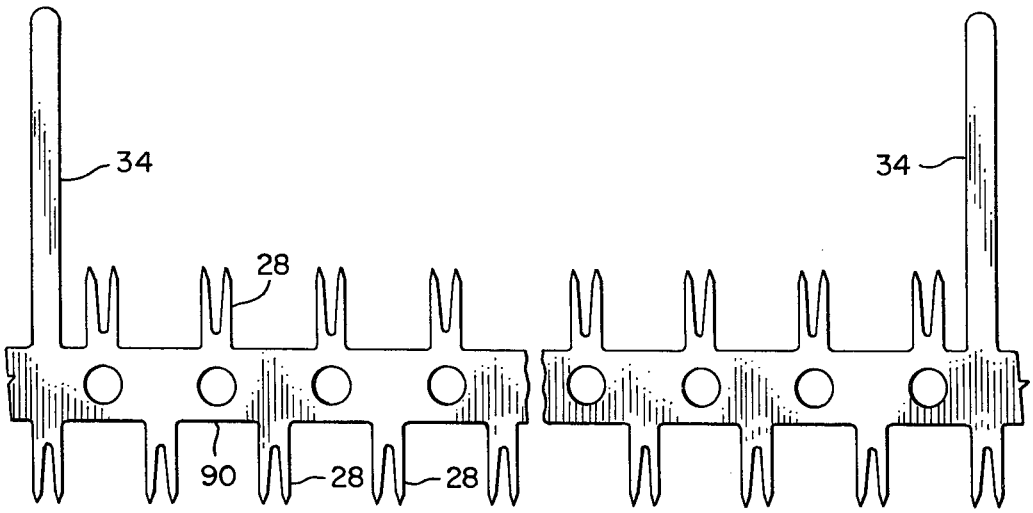
FIG. 4 is a fragmentary top plan view of a stamped element prior to its formation into a contact strip for a terminating means constructed in accordance with the concepts of the invention.
Figure 5:
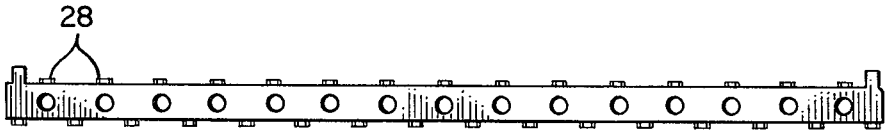
FIG. 5 is a top plan view of a contact strip constructed from the stamped element of FIG. 4.
Figure 6:
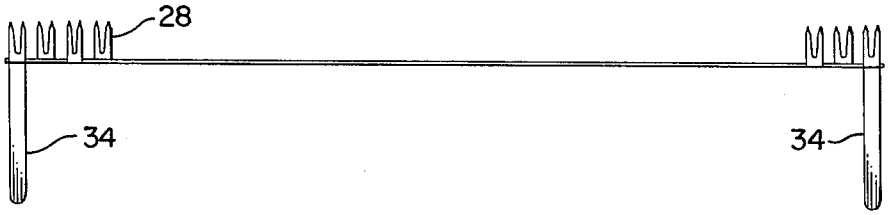
FIG. 6 is a side elevational view of the strip of FIG. 5.
Figure 7:
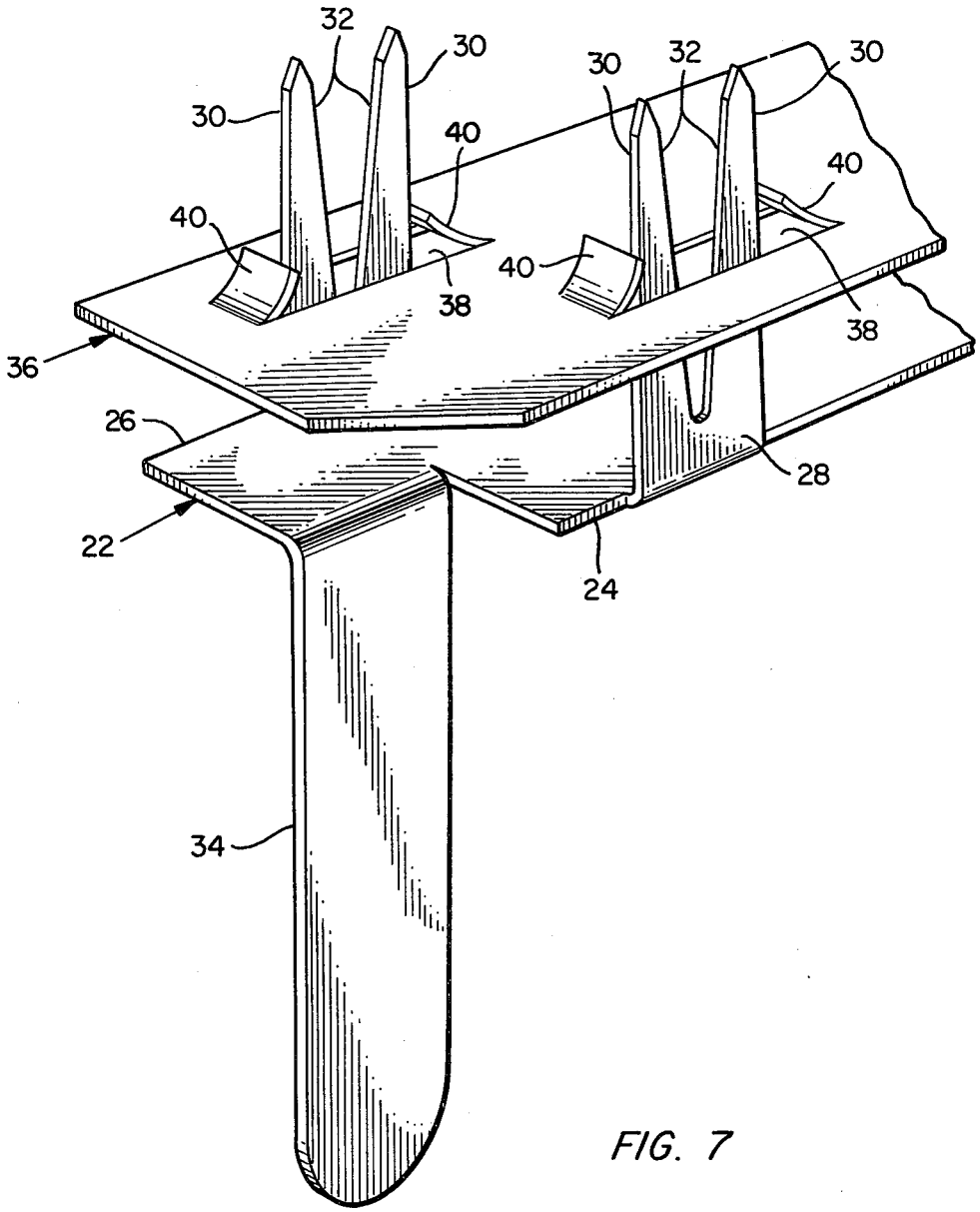
FIG. 7 is a fragmentary perspective view showing the contact strip and the retainer strip of the terminating means of FIG. 1 in assembled condition.
Figure 8:
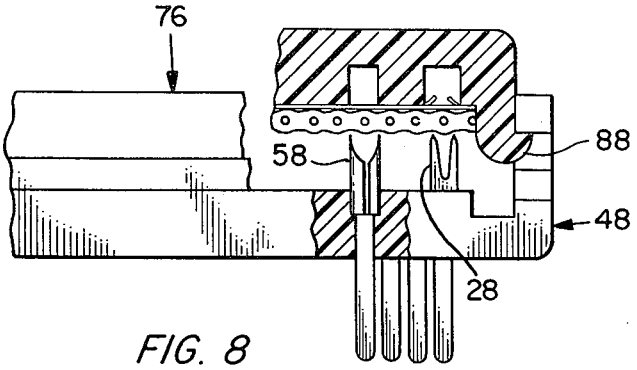
FIG. 8 is a side elevational view, partly cut away and partly in section, showing the terminating means of FIG. 1 in a partially assembled state.
Figure 9:
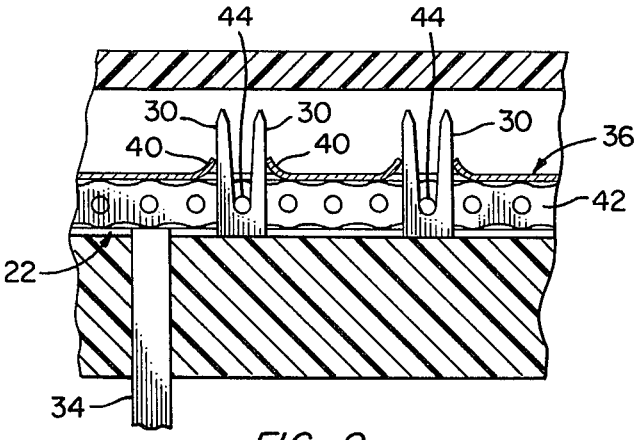
FIG. 9 is a fragmentary side elevational view, partly in section, showing a portion of the terminating means of FIG. 1 is a fully assembled condition.
Figure 11:
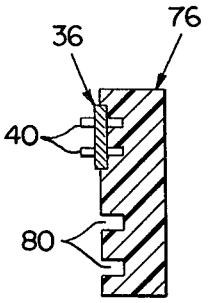
FIG. 11 is a sectional view taken along the line 11—11 of FIG. 10.
Figure 10:
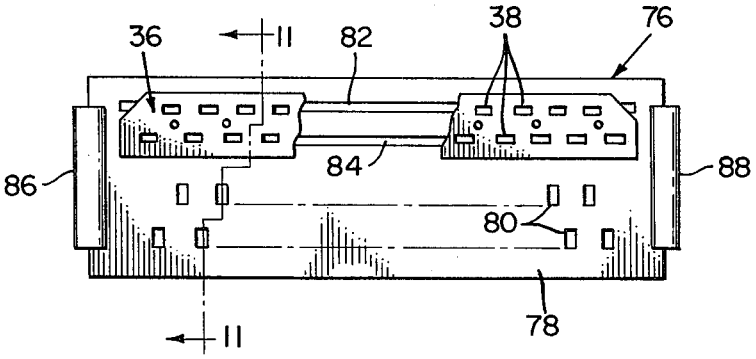
FIG. 10 is a top plan view, partly cut away, showing a portion of the terminating means of FIG. 1.

Turning now to FIGS. 1 through 11 there is shown an exploded view (FIG. 1) of a flat cable terminating means 20 constructed in accordance with the concepts of the invention and comprising an elongate flat metallic contact plate 22 having extending along the opposing edges 24 and 26 thereof bifurcated upstanding contact elements 28 disposed generally perpendicular to the plane of the plate 22, each of said contact elements 28 being formed so as to provide a pair of opposing tines 30 having sharp inner edges 32 (FIG. 7). The tines 30 are formed so as to provide a V-shaped notch therebetween, although the actual shape of the notch may be varied somewhat without departing from the spirit of the invention and within the concepts herein disclosed. Extending downwardly from either end of the contact plate 22 are leg portions 34 adapted to provide a convenient terminal point whereby the contact plate 22 may be electrically coupled to a further element as, for example, by soldering or direct contact. Positioned above and coincident with the contact plate 22 is an elongate metallic retainer plate 36 having a series of apertures 38 individually located so as to coincide with respective tines 30 of the contact elements 28. Each of the apertures 38 is formed preferably by lancing, although other suitable metal working means may be employed, and each aperture 38 is flanked by upstanding metal finger portions 40 resulting from the lancing or other suitable blanking or punching operation. Each pair of finger portions 40 is arranged to overhang a respective aperture 38 to partially restrict the opening thereof and to act as tine locking means by tightly receiving therebetween a respective pair of tines 30 in the manner generally shown in FIG. 7. To effect the mating interengagement between the tines 30 and the apertures 38 as shown in FIG. 7, each tine 30 is dimensioned to have a length sufficient to penetrate through the thickness of an insulated multiconductor flat, flexible cable 42 (FIG. 1) and enter the aperture 38 in the retainer plate 36. The cable 42 is comprised of a series of longitudinally extending parallel conductive elements 44 lying in a common plane. Each conductive element 44 is surrounded by relatively compliant dielectric material 46 which forms an electrically insulating barrier between adjacent conductive elements 44. The dielectric material 46 also covers the upper and lower surfaces of the cable 42, providing an insulating film or sheath thereabout. To provide a convenient support and insulating barrier for the contact strip 22, there is provided a base member 48 having an elongate recessed portion 50 for receiving the plate 22. At either end of the recessed portion 50 is a transverse aperture 52 (only one being visible in FIG. 1) to receive the leg portions 34. The base member 48 is constructed of electrically insulating material and includes an inner surface 54 in which is located the recessed portion 50, and a series of openings 56 in which are disposed a like number of discrete contact members 58 for engaging selective ones of the conductive elements 44. The base member 48 further comprises end portions 60 and 62 from which extend shoulder portions 64 and 66, respectively, each shoulder portion 64, 66 having two spaced elongated slots 68 and 70, and 72 and 74, respectively, for providing selective coupling between the base member 48 and a cover member 76 which is also constructed of electrically insulating dielectric material, and includes an inner surface 78 (FIG. 10) having a series of cavities or pockets 80 for receiving the exposed end of the contact members 58. The retainer plate 36 is supported on the inner surface 78 of the cover member 76 and overlies a pair of longitudinally extending grooved portions 82 and 84 (FIG. 10), each of which is selectively positioned so as to coincide with a particular row of apertures 38 to accommodate the extending ends of the tines 30. To matingly and selectively couple the cover member 76 to the base member 48, the cover member 76 is provided with lip portions 86 and 88 at opposing ends thereof for selective engagement with the respective base member slots 68, 70, and 72, 74. In a first coupled position, as shown in FIG. 8 with respect to one end of the terminating means 20, although a similar arrangement is provided at the other end thereof, the lip 88 is engaged within the upper slot 74 of the two slots 72 and 74 to provide a narrow passageway between the base member 48 and the cover member 76 for receiving and selectively positioning a given portion of the cable 42 between the two members 48 and 76 adjacent the contact elements 28 and the contact members 58. In a second coupled position, as exemplified in FIG. 2 with respect to the other end of the terminating means 20, the lip 86 is engaged within the lower slot 68 of the two slots 68 and 70, by urging the cover member 76 and the base member 48 together, thereby causing the piercing tines 30 to penetrate the cable 42, the inner edges of each pair of tines 30 straddling and contacting a respective conductive element 44. Accordingly, each of the conductive elements 44 which is contacted by a pair of respective tines 30 is thereby joined by a metallic bridge to all other conductive elements 44 similarly contacted by the remaining tines 30 of the contact element 28, thus providing a common juncture for such conductive elements 44. As shown in the open view of FIG. 3, the tines 30 are arranged in offset rows on the contact plate 22 so as to increase the spacing between adjacent pairs of tines 30, a feature which is found to be extremely useful where the spacing between adjacent conductive elements 44 is relatively small. In the example shown in FIG. 3, the pairs of tines 30 are arranged so as to contact alternate conductive elements 44, the intervening conductive elements 44 being engaged by one of the discrete contact members 58. Thus, the alternate conductive elements 44 straddling a particular conductive element 44 are joined to one another by virtue of the contact plate 22 and may, if necessary or desirable, be coupled to a convenient ground connection through the integral leg portion 34, as by a connection to a terminal 77 (FIG. 2) thus providing signal isolation between the respective signal carrying conductive elements 44 which are electrically connected to the discrete contact members 58. It should be understood that the contact members 58 are selectively located with respect to the contact elements 28 so as to engage those conductive elements 44 located intermediate the contact elements 28. As further illustrated in FIG. 9, the free ends of the tines 30 extend through the cable 42 after the terminating operation and are embraced by the finger portions 40 of the retainer plate 36. Each pair of finger portions 40 are disposed at an oblique angle to the plane of the retainer plate 36 and converge towards one another so as to provide a gap therebetween dimensioned to be slightly narrower than maximum width of a respective pair of tines 30. Thus, the sharp free edges of the finger portions 40 are caused to engage the side edges of the tines 30, after insertion, to provide a locking action therebetween. It will be appreciated that the finger portions 40, being cantileveredly connected at their respective base ends to the retainer plate 36, are somewhat free to deflect under the influence of the entering tines 30, the stored energy in the finger portions 40 thus causing them to tend to return to their original position and, consequently, generating a locking force against the side edges of the tines 30, maintaining secure, reliable, and continuous electrical and mechanical interengagement between these elements after assembly. As further illustrated in FIGS. 4, 5, and 6, the retainer plate 36 may be constructed from a blanked element 90 shown in the flat state in FIG. 4. The contact elements 28 are then folded up perpendicular to the plane of the element 90 as shown in the respective top and side views of FIGS. 5 and 6. The leg portions 34 are folded in a direction opposite to that of the contact elements 28 so as to permit a convenient attachment thereto. It will be noted that the contact elements 28 when folded up into their final position, lie in respective rows along either edge of the blanked element 90 and the contact elements of each row are oriented in a common plane parallel to the longitudinal axis of the element 90 and perpendicular to the plane thereof, thus orienting the contact elements 28 in crosswise relationship to the run of the conductive elements 44 of the cable 42 as the plate 22 is placed thereacross. It should be understood that the particular arrangement of the contact elements 28 may be varied to suit a particular purpose, and that additional or less contact elements 28 may be provided in accordance with a particular application. Additionally, other contact elements 28 may be formed from the central portion of the element 90. In any case, however, the retainer plate 36 is provided with a given number and arrangement of apertures 38 coinciding with the number and arrangement of contact elements 28. It should also be appreciated that the contact and retainer plates 22 and 36, respectively, are constructed preferably of metallic material having good electrical conductivity, such as copper, aluminum, and various suitable alloys thereof.

The embodiments of the invention in which an exclusive property or privilege is claimed are defined as follows:

1. Terminating apparatus for multiconductor flat flexible cable comprising, in combination: an elongate metallic contact plate having a plurality of contact elements having tines extending outwardly therefrom and integral therewith; and an elongate metallic retainer plate having a plurality of apertures, one for each of said contact elements and located therein coincident with corresponding ones of said plurality of contact elements and dimensioned to receive and embrace said tines of corresponding ones of said contact elements; said contact plate and said retainer plate being arranged to receive therebetween a portion of a flat flexible cable and to be urged together so that said tines of each of said contact elements penetrate the insulation of such cable about a corresponding conductor thereof and enter a corresponding one of said apertures of said retainer plate, thereby providing a common electrical connection between such corresponding conductors through said contact plate and said retainer plate.

2. Terminating apparatus as defined in claim 1 wherein said contact plate comprises at least one row of contact elements, said tines of said contact elements of said row lying in a common plane.

3. Terminating apparatus as defined in claim 1 wherein said apertures of said retainer plate comprise lanced openings in which a portion of the metal displaced from each said opening partially overhangs said opening to provide tine locking means thereat.

4. Terminating apparatus as defined in claim 1 wherein said contact plate further comprises a leg portion extending outwardly from one end thereof to provide a connecting means to an external member.

5. Terminating apparatus as defined in claim 1 wherein said contact elements extend outwardly generally normal to the plane of said contact plate.

6. Terminating apparatus as defined in claim 5 wherein said contact plate comprises two parallel rows of contact elements extending along opposite edges of said contact plate.

7. Terminating apparatus as defined in claim 6 wherein said tines of a particular row of said contact elements lie in a common plane.

8. Terminating apparatus as defined in claim 7 wherein said common plane is oriented generally normal to the plane of said contact plate.

9. Terminating apparatus as defined in claim 6 wherein said contact elements of one of said rows are laterally offset from said contact elements of the other of said rows.

10. Terminating apparatus as defined in claim 9 wherein said tines of each of said rows of said contact elements lie in a given common plane oriented generally normal to the plane of said contact plate and extending generally parallel to the longitudinal axis of said contact plate.

11. Terminating apparatus as defined in claim 10 wherein said tines of each of said contact elements each have a sharpened inner edge for cutting through the insulation covering the conductors of such multiconductor flat cable.

12. Terminating apparatus as defined in claim 11 wherein each of said contact elements comprise a pair of tines, said inner edges thereof being arranged to provide a V-shaped opening therebetween.

13. A connector for multiconductor flat flexible cable comprising, in combination: an elongate metallic contact plate having at least one row of conductor engaging contact elements thereon and a leg portion for connecting said contact plate to an external element; an elongate metallic retainer plate having transverse apertures therethrough cooperative with said contact elements of said contact plate to provide locking means therefor as said contact plate and said retainer plate are disposed on opposite sides of a portion of a multiconductor flexible flat cable; a base member having an elongate recessed portion, said contact plate being disposed in said recessed portion, said base member having a plurality of transverse openings adjacent said first recessed portion; a plurality of discrete contact members, one for each of said openings in said base member and disposed in said openings in preselected arrangement, each of said contact members having conductor engaging portions for establishing contact with preselected conductors of such multiconductor flat cable; a cover member overlying said base member and having an outer surface and an inner surface, and means on said inner surface for receiving said retainer plate, said retainer plate being attached to said inner surface of said cover member, said cover member having means coupling said cover member to said base member, wherein a given portion of such multiconductor flat cable may be placed between said base member and said cover member and said members urged together to cause said contact elements of said contact plate to penetrate the insulation about selective conductors of such multiconductor flat cable and contact such conductors to join such conductors one to another through such contact plate, said contact elements of said contact plate each having free end portions arranged to pierce through such insulation of such multiconductor flat cable and enter said transverse apertures in said retainer plate for engagement therewith.

14. A connector as defined in claim 13 wherein said base member has a transverse passageway through which extends said leg portion of said contact plate.

15. A connector as defined in claim 13 wherein said apertures of said retainer strip comprise lanced openings having overhanging metallic portions arranged to embrace said free end portions of respective ones of said contact elements.

16. A connector as defined in claim 15 wherein said inner surface of said cover member has elongate grooved portions therein coinciding with said lanced openings in said retainer strip to receive said overhanging metallic portions.

17. A connector as defined in claim 13 wherein said cover member inner surface comprises a plurality of cavities coinciding with said contact members disposed in said base member to provide a pocket for extending portions of said contact members upon the closure of said cover member to said base member.

18. A connector as defined in claim 17 wherein said cavities are aligned in at least one row adjacent said recessed portion.

19. A connector as defined in claim 13 wherein said means coupling said cover member to said base member comprises releasable mating elements on said cover member and said base member, said mating elements being arranged to have a first mating position and a second mating position, said first mating position being arranged so that said cover member and said base member are spaced apart a given distance to permit the insertion therebetween of a given portion of such multiconductor flat cable, said second mating position being arranged so that the spacing between said cover member and said base member is less than that of said first mating position to tightly entrap such given portion of such multiconductor flat cable therebetween.

20. A connector as defined in claim 19 wherein said mating elements comprise apertured shoulder portions at the respective ends of said base member, and lip portions at the respective ends of said cover members, said lip portions engaging selective ones of said apertured portions to provide a coupled assembly of said cover member and said base member.

21. A method of simultaneously interconnecting selective conductors of a multiconductor flat flexible cable comprising the steps of: sandwiching a given portion of an insulated multiconductor flat flexible cable between two metallic strips, a first of which is provided with selectively spaced upstanding bifurcated piercing elements formed integrally therewith, the other of which is provided with selectively spaced apertures arranged to mate with said piercing elements; aligning said two strips with respect to one another so that said piercing elements are coincident with respective ones of said apertures; and urging said two strips together to cause said bifurcated piercing elements to penetrate said insulation about and contact the conductive portion of selective ones of said conductors, and to cause the free ends of said bifurcated piercing elements to enter said apertures and be embraced thereby.

22. A method as defined in claim 21 further comprising the step of attaching each of said two metallic strips to respective electrically insulating members to provide an insulated assembly.

23. A method as defined in claim 21 comprising the step of forming said apertures by lancing so as to provide upstanding metallic finger portions for engaging respective ones of said piercing elements.

24. A method as defined in claim 23 further comprising the step of coupling said first of said strips to an external grounding point to provide a contiguous ground connection to said selective ones of said conductors.

25. A method as defined in claim 23 comprising the step of orienting said finger portions in converging relationship to lockingly receive respective ones of said bifurcated piercing elements.

* * * * *